US007882858B2

(12) United States Patent
Keller

(10) Patent No.: US 7,882,858 B2
(45) Date of Patent: Feb. 8, 2011

(54) APPARATUS FOR FILLING STORAGE CONTAINERS ON DISPENSING APPLIANCES

(75) Inventor: Wilhelm A. Keller, Merlischachen (CH)

(73) Assignee: Sulzer Mixpac AG, Haag (CH)

( * ) Notice: Subject to any disclaimer, the term of this patent is extended or adjusted under 35 U.S.C. 154(b) by 1097 days.

(21) Appl. No.: 10/569,828

(22) PCT Filed: Aug. 19, 2004

(86) PCT No.: PCT/CH2004/000522

§ 371 (c)(1),
(2), (4) Date: Dec. 7, 2006

(87) PCT Pub. No.: WO2005/021166

PCT Pub. Date: Mar. 10, 2005

(65) Prior Publication Data

US 2007/0107802 A1 May 17, 2007

(30) Foreign Application Priority Data

Sep. 1, 2003 (CH) ..... 1497/03

(51) Int. Cl.
*B65B 1/04* (2006.01)

(52) U.S. Cl. ..... 141/18; 141/2; 141/113; 141/263; 141/269; 141/350; 141/354

(58) Field of Classification Search ..... 141/2, 141/18, 10, 113, 250, 263, 267, 269, 311 R, 141/346, 348, 349, 350, 351, 353, 354
See application file for complete search history.

(56) References Cited

U.S. PATENT DOCUMENTS

| | | | | |
|---|---|---|---|---|
| 3,301,272 | A | 1/1967 | Karlin et al. | |
| 4,638,842 | A * | 1/1987 | Hawley et al. | 141/302 |
| 4,919,174 | A * | 4/1990 | Warland | 141/384 |
| 6,260,577 | B1 * | 7/2001 | Keller | 137/565.37 |
| 2004/0000351 | A1 * | 1/2004 | Cao et al. | 141/9 |

FOREIGN PATENT DOCUMENTS

| | | |
|---|---|---|
| EP | 1 000 669 A | 5/2000 |
| GB | 2 349 672 A | 11/2000 |

* cited by examiner

*Primary Examiner*—Timothy L Maust
*Assistant Examiner*—Jason K Niesz
(74) *Attorney, Agent, or Firm*—Foley & Lardner LLP

(57) ABSTRACT

In a device for filling dispensing appliances having a pump unit with a metering cylinder and a storage container for each component, a respective coupling arrangement (5) is provided between each storage container (2, 3) and an associated coupling of a filling station. In a preferred embodiment, the appliance coupling part (28) is arranged in an inlet nozzle (17) of the dispensing appliance (1) and the station coupling part (29) in a guide (31) in the enclosure (33) of the filling station (30). This device allows a quick and simple filling of storage containers without contaminations and air entrapment.

14 Claims, 3 Drawing Sheets

APPARATUS FOR FILLING STORAGE CONTAINERS ON DISPENSING APPLIANCES

The present invention relates to an apparatus for filling storage containers on dispensing appliances having a pump unit and a metering cylinder for each component according to the preamble of claim 1. A dispensing appliance of this kind is e.g. known from EP-A-0 787 535 to the applicant of the present invention. The dispensing appliance described in this reference is designed for at least two components, the latter being filled into respective storage containers.

A dispensing tool and a method for dispensing and reloading is known from GB-A-2 349 672 where respective lines from storage containers lead to the appliance from below and approximately in parallel to each other and are directly connectable to the metering cylinders by means of a coupling device. Whenever the metering cylinders are empty, they have to be refilled.

According to other prior art, for reloading storage containers that are connected to the metering cylinders, the lid of the storage container is unscrewed and the container filled by a hose or the like. Essentially, this method suffers from two serious disadvantages, namely that air and contaminations may enter into the storage container while the lid is removed and the storage container is filled, on one hand, and that the procedure is time-consuming, on the other hand.

Furthermore, a transfer system including a hose connection between bulk material containers and the storage containers of the dispensing appliance is known from EP-A-1 000 669 to the applicant of the present invention.

On the background of this prior art, the object of the present invention is to provide a device for filling dispensing appliances that allows a rational and rapid filling of storage containers that are connected to the metering cylinders without entrapped air and contaminations in the components that are being filled in.

This is accomplished by a device as defined in independent claim 1.

The invention will be explained in more detail hereinafter with reference to drawings of an exemplary embodiment.

Figure 1:
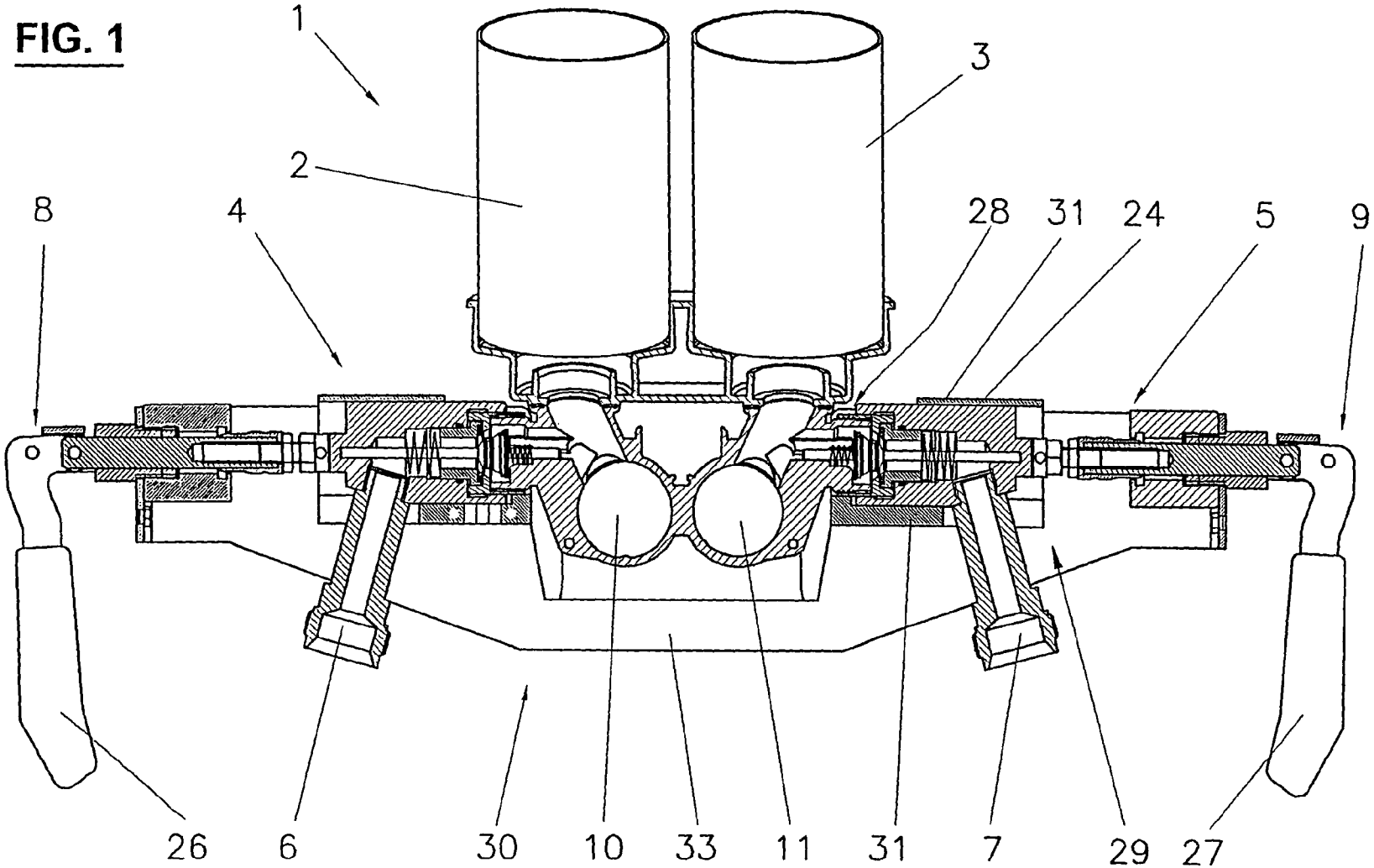
Figure 2:
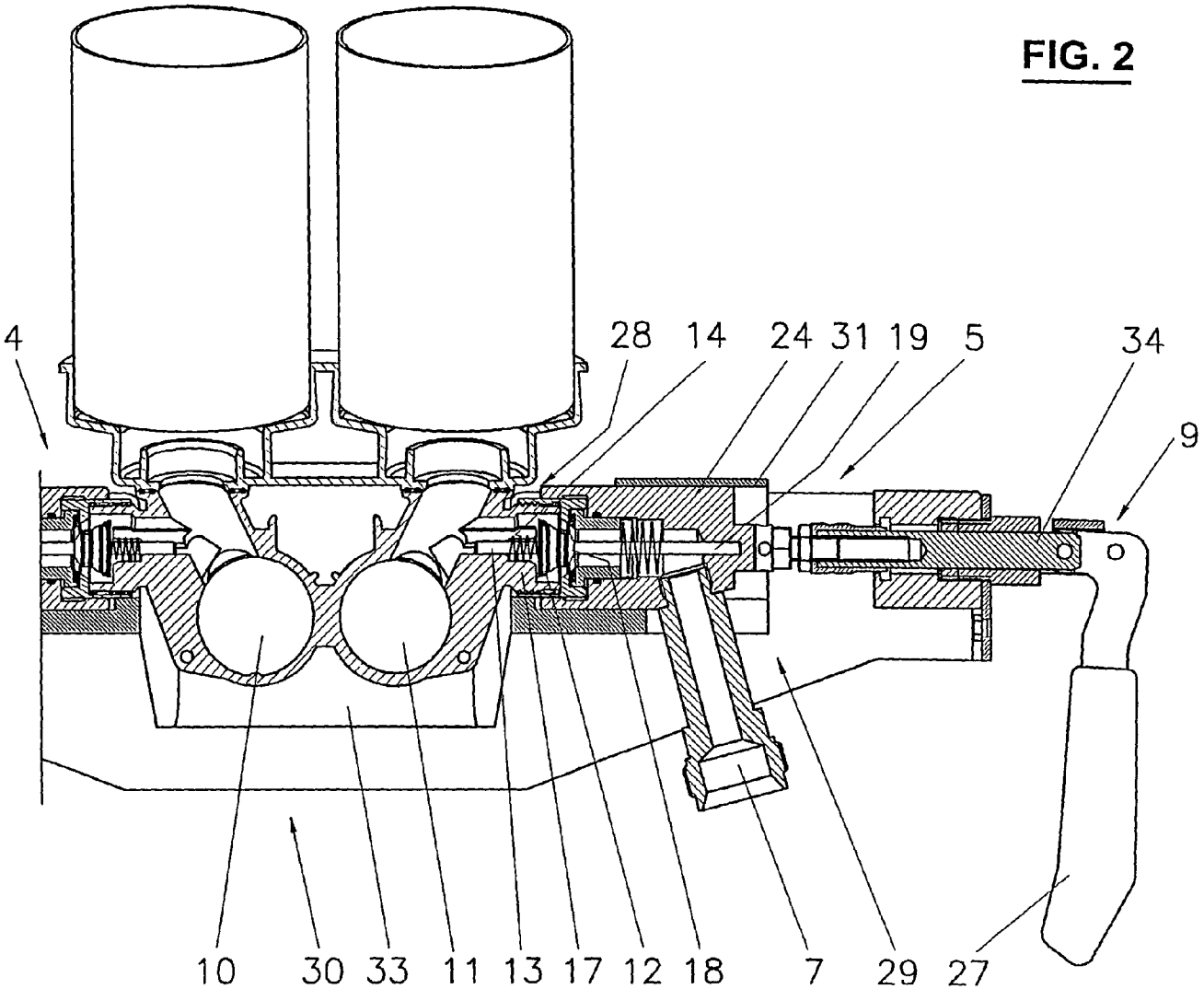

FIG. 1 shows a sectional view of the parts of a dispensing appliance and of the filling device of the invention that are essential for the filling operation, FIG. 2 shows an enlarged detail of FIG. 1, and FIGS. 3-5 show three different phases during the actuation of a coupling arrangement according to FIG. 1 in a further enlarged detail.

The sectional view of FIG. 1 shows parts of a dispensing appliance 1 having storage containers 2 and 3 as well as parts of a filling station 30 including coupling arrangements 4 and 5 associated to each storage container, respective couplings 6 and 7, as well as respective quick clamps 8 and 9 with handles 26 and 27 for the actuation of the coupling arrangements.

The outlets of the storage containers communicate with respective metering units 10 and 11 as they are e.g. described in EP-A-0 787 535 that has been cited in the introduction. It is further apparent in FIGS. 1 and 2 that in order to be filled, the dispensing appliance is placed between the two couplings of the filling station and the connection is established by means of the quick clamps while the dispensing appliance is being firmly maintained.

Hereinafter, only one of the two identical coupling arrangements of the filling station will be described. Coupling arrangement 5 is composed of an appliance coupling part 28 and of a station coupling part 29. Station coupling part 28 comprises a valve head 12 on a valve stem 13 that is surrounded by a compression spring 14 in order to keep the valve head closed and to press it against the valve seat in centering sleeve 15. The valve head further comprises a sealing ring 16, see FIG. 3. Appliance coupling part 28 is arranged on inlet nozzle 17 of the dispensing appliance.

Station coupling part 29 is part of filling station 30 and comprises an opening push rod 18 on a push rod shaft 19 that is surrounded by a compression spring 20 whose spring force pushes the sealing cylinder against centering sleeve 15 after coupling. Opening push rod 18 and push rod shaft 19 are axially supported in a coupling head 24 and arranged in a sealing cylinder 21 that is axially displaceable with respect to cylindrical coupling head 24 and is sealed by means of a joint 25 and under the action of spring 20.

Coupling head 24 is guided in a cylindrical guide 31 that is secured to support 33 of the filling station, and it communicates with a centering portion 32 on its appliance side while receiving push rod shaft 19 as well as coupling 7 at its other end. Coupling head 24 is actuated by quick clamp 9 via a shaft 34 that is supported in support 33.

In the same manner as the valve head, the front end of the opening push rod is shaped conically, the conical surface being sealed against sealing cylinder 21 by a joint 22 disposed in the sealing cylinder and by the following cylindrical surface having a sealing ring 23 arranged therein.

Figure 3:
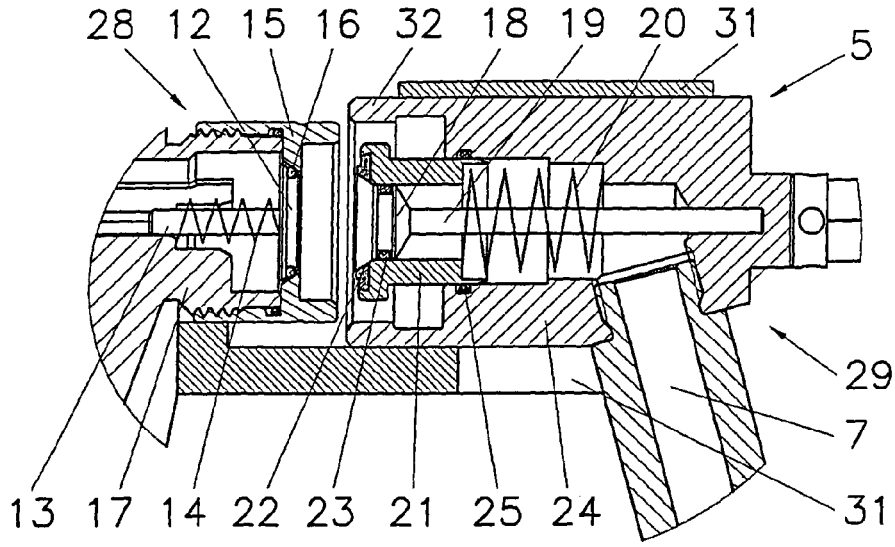

As follows from FIGS. 3 to 5, joint 22 seals both the opening push rod against the sealing cylinder and, see FIG. 5, the sealing cylinder against the centering sleeve on the inlet nozzle, thereby preventing liquid leakage and the entrance of air or contaminations.

Hereinafter the individual phases during coupling and uncoupling will be described while it is noted that the opening push rod and valve head movements are relative movements. FIG. 3 illustrates the basic position; the coupling head with outlet 7 and the inlet nozzle of the dispensing appliance are closed and sealed.

Figure 4:
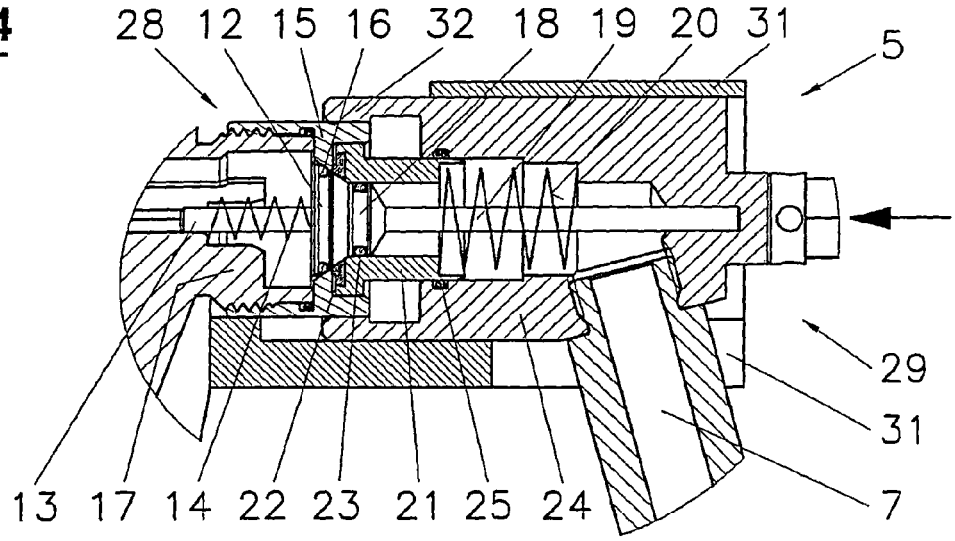

FIG. 4 illustrates the beginning of the closing operation. Actuated by the quick clamp, the coupling head including the sealing cylinder, the push rod shaft and the opening push rod is driven against the valve head of the appliance coupling part and centering portion 32 slides over the centering sleeve, thereby displacing the air and sealing the junction of the coupling head and inlet nozzle by means of joint 22. The coupling head is pushed further until it abuts to the front edge of the centering sleeve while the opening push rod is pushing back the valve head, thereby reaching the position of FIG. 5.

Figure 5:
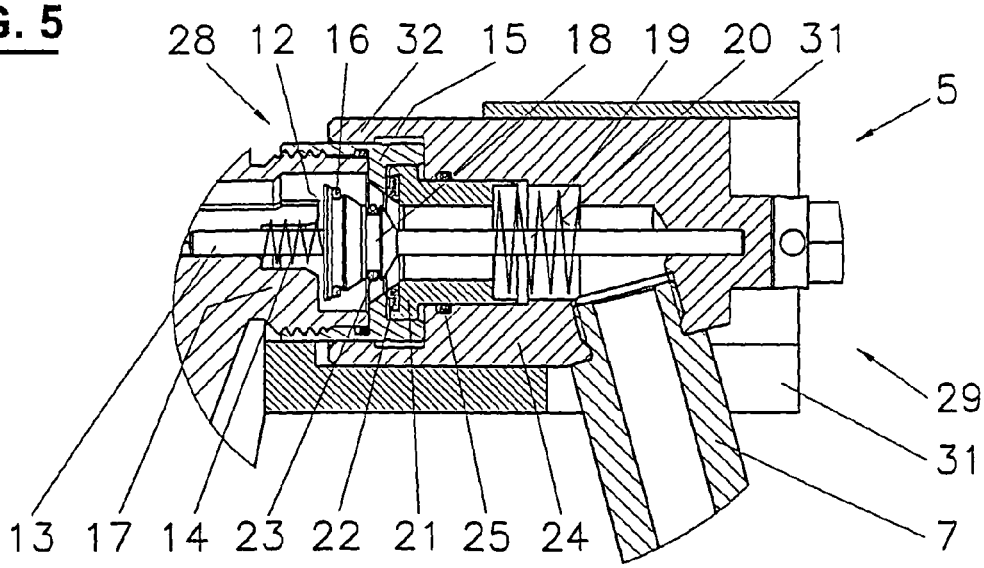

In FIG. 5, both the valve in the coupling head and the valve in the inlet nozzle are open but the system as a whole is sealed by joint 22 so that the filling operation can be started, e.g. by operating a feeding pump.

After the filling operation, the quick clamp is unlocked and the opening valve and the valve head move back, and the partial systems are again tightly sealed. When the coupling head has reached its end position, the dispensing appliance can be removed from the filling station.

In FIG. 1 it is apparent that each component, i.e. each container includes a respective coupling arrangement that can be closed and opened by respective quick clamps 8 and 9 with handles 26 and 27 that are acting on the coupling heads and thus on the push rod shafts of the opening push rods, the quick clamp being known per se. In automated versions, the manually operated quick clamps can be replaced with mechanical and/or electric and/or pneumatic and/or hydraulic devices.

It follows from the description of the device that the two coupling arrangements are arranged on the same axis and opposite each other, the two partial systems, i.e. the appliance coupling part and the station coupling part, are each tightly sealed by valves, the partial systems are uncritical to adhesive clogging as only one component flows in each one of them, the coupling point is air-free as the air therein can completely escape, both low and high viscosity media can be filled in, the coupling arrangement allows a solid construction and is arranged in a self-centering manner and easy to handle, and the appliance is tightly maintained during the filling operation and then released.

The handling operations are very simple, i.e. the dispensing appliance is placed in the receptacle of the filling station, the quick clamps are closed and the containers filled, after which the quick clamps are opened and the filled dispensing appliance is functional again.

The filling device of the invention may either comprise only one coupling arrangement or more than two coupling arrangements, depending on the number of storage containers to be filled.

The invention claimed is:

1. A device for filling storage containers on a dispensing appliance having a pump unit and a metering cylinder for each component, the storage containers being connected to the metering cylinders, wherein the device comprises:

a filling station, for receiving the dispensing appliance, that includes a coupling arrangement located between each storage container and an associated coupling of the filling station, wherein each coupling arrangement includes an appliance coupling part and a station coupling part wherein the coupling arrangements are arranged on a same axis and opposite each other between the outlets of the storage containers and the inlets of the metering units, and wherein the appliance coupling part is arranged on an inlet nozzle of the dispensing appliance and the station coupling part is arranged in a guide in a support of the filling station.

2. The device of claim 1, wherein the station coupling part includes a coupling head that is displaceable with respect to the guide, a sealing cylinder that receives an opening push rod and is displaceable with respect to the coupling head, and a centering portion that is slidable over a centering sleeve on the inlet nozzle of the dispensing appliance.

3. The device of claim 1, wherein the appliance coupling part comprises a valve head under the action of a first compression spring, wherein an opening push rod in the station coupling part is under the action of a second compression spring, wherein a push rod shaft of the opening push rod is secured in a coupling head, and wherein the coupling head is actuatable by an actuating member.

4. The device of claim 1, wherein the coupling arrangement comprises sealing means that seal a valve head and an opening push rod against the inlet nozzle.

5. The device of claim 4, wherein the opening push rod is arranged in a sealing cylinder that is disposed in the coupling head and is sealed against the coupling head by means of a joint.

6. The device of claim 1, wherein the coupling head comprises a joint arranged in the sealing cylinder that seals the sealing cylinder both against a conical portion of an opening push rod and against the inlet nozzle.

7. The device of claim 1, wherein the device further comprises two coupling arrangements that are each actuatable by mechanical and/or electric and/or pneumatic and/or hydraulic actuating means.

8. A method for filling storage containers on a dispensing appliance with a device according to claim 1, wherein the dispensing appliance is introduced in the opened filling station and by actuating quick clamps, both the dispensing appliance is clamped and valves in the appliance coupling part and in the station coupling part are opened, after which, by unlocking and actuating the quick clamps, the valves are closed and the dispensing appliance is released and may be removed.

9. The device of claim 2, wherein the appliance coupling part comprises a valve head under the action of a first compression spring, wherein the opening push rod in the station coupling part is under the action of a second compression spring, wherein a push rod shaft of the opening push rod is secured in the coupling head, and wherein the coupling head is actuatable by an actuating member.

10. The device of claim 2, wherein the coupling arrangement comprises sealing means that seal a valve head and the opening push rod against the inlet nozzle.

11. The device of claim 10, wherein the opening push rod is arranged in a sealing cylinder that is disposed in the coupling head and is sealed against the coupling head by means of a joint.

12. The device of claim 2, wherein the coupling head comprises a joint arranged in the sealing cylinder that seals the sealing cylinder both against a conical portion of the opening push rod and against the inlet nozzle.

13. The device of claim 2, wherein the device further comprises two coupling arrangements that are each actuatable by mechanical and/or electric and/or pneumatic and/or hydraulic actuating means.

14. A method for filling storage containers on a dispensing appliance with a device according to claim 2, wherein the dispensing appliance is introduced in the opened filling station and by actuating quick clamps, both the dispensing appliance is clamped and valves in the appliance coupling part and in the station coupling part are opened, after which, by unlocking and actuating the quick clamps, the valves are closed and the dispensing appliance is released and may be removed.

* * * * *